US011618669B2

(12) United States Patent
Chang

(10) Patent No.: US 11,618,669 B2
(45) Date of Patent: Apr. 4, 2023

(54) SAFETY STIRRUP

(71) Applicant: JONE SHOU INDUSTRIAL CO., LTD., Nantou County (TW)

(72) Inventor: Chih Shun Chang, Nantou County (TW)

(73) Assignee: JONE SHOU INDUSTRIAL CO., LTD., Nantou County (TW)

( * ) Notice: Subject to any disclaimer, the term of this patent is extended or adjusted under 35 U.S.C. 154(b) by 0 days.

(21) Appl. No.: 17/465,969

(22) Filed: Sep. 3, 2021

(65) Prior Publication Data

US 2023/0072057 A1 Mar. 9, 2023

(51) Int. Cl.
*B68C 3/00* (2006.01)
*B68C 3/02* (2006.01)

(52) U.S. Cl.
CPC ..... *B68C 3/02* (2013.01); *B68C 2003/0058* (2013.01); *B68C 2003/0083* (2013.01)

(58) Field of Classification Search
CPC .... B68C 2003/0008; B68C 2003/0041; B68C 2003/005; B68C 2003/0083; B68C 2003/0091; B68C 3/02; B68C 3/00
See application file for complete search history.

(56) References Cited

U.S. PATENT DOCUMENTS 3,910,015 A * 10/1975 Ebejer ..... B68C 3/00 54/49
5,170,574 A * 12/1992 Weisbrich ..... A43B 5/00 36/131
5,172,538 A * 12/1992 Luger ..... B68C 3/00 54/47
8,984,849 B1 * 4/2015 Cohen ..... B68C 3/00
2006/0096256 A1 * 5/2006 Chang ..... B68C 3/00 54/48
2019/0144259 A1 5/2019 Benetti

* cited by examiner

*Primary Examiner* — Joshua E Rodden
*Assistant Examiner* — Henry Hooper Mudd
(74) *Attorney, Agent, or Firm* — Muncy, Geissler, Olds & Lowe, P.C.

(57) ABSTRACT

A safety stirrup includes a C-shaped frame and a supporting assembly. A pivot portion and a first connecting portion are respectively disposed at two ends of the opening of the frame. An arm with a second connecting portion is pivotally connected to the pivot portion and is selectively connected with the first connecting portion. The supporting assembly consists of a first plate, a second plate with elasticity and a third plate. The third plate is stacked on the bottom portion of the frame. The second plate is stacked on the third plate. The first plate is stacked on the second plate with a higher position of a front end than that of a rear end.

9 Claims, 10 Drawing Sheets

SAFETY STIRRUP

BACKGROUND OF THE INVENTION

1. Technical Field

The present invention relates to equestrian equipment and more particularly to a stirrup.

2. Description of Related Art

Horse is an important means of transportation in ancient times. Craftsmen invented saddles and stirrups in order for steadily riding on the horse. Although horse riding has been transformed into a kind of leisure activities for entertainment, equestrian equipment is still continuously improved for the purpose of comfortably riding.

A stirrup disclosed in US published application No. 2019/0144259A1 includes a C-shaped frame, an arm and a supporting member. The frame is provided with a through hole for a strap to tie with and to hang the frame. The arm is pivotally connected with an opening of the frame. The supporting member is secured to a bottom portion of the frame. The supporting member has an uniform height so that a top surface is parallel to the horizontal when the stirrup is hung naturally. The sole cannot completely engages with the supporting member since it tilts as a result of muscle tightening when stepping on the supporting member which is smaller than the sole. It might be dangerous if the sole slips from the supporting member.

Moreover, the sole will withstand a strong impact force at the moment of landing after a rider controls the horse to perform a jumping action. Due to inelasticity of the supporting member of the conventional stirrup, the impact is fully transmitted to the sole, causing discomfort to the rider or damage to the stirrup.

BRIEF SUMMARY OF THE INVENTION

The primary objective of the present invention is to provide a safety stirrup having an inclined supporting assembly with a higher front end than a rear end, which facilitates performing actions to horse riding. The supporting assembly can be replaced by one with different slope. Besides, the supporting assembly of the present invention is able to cushion the impact force when a jumping horse lands.

To achieve the above objective, the present invention provides a safety stirrup that includes a C-shaped frame, an arm and a supporting assembly. The C-shaped frame extends parallel to a first vertical plane. The frame has an upper end with a pivot portion, a lower end with a first connecting portion and an opening between the upper end and the lower end. A top portion of the frame is provided with a hanging hole for a strap to tie with. The arm is pivotally connected with the pivot portion to be swung parallel to the first vertical plane. The arm includes a second connecting portion which is selectively secured to the first connecting portion to close the opening. The supporting assembly consists of a first plate, a second plate with elasticity and a third plate. The third plate includes a groove portion to be secured to a bottom portion of the frame. The second plate is stacked on the third plate with a higher position of a front end of the second plate than that of a rear end of the second plate. The first plate is stacked on the second plate with a higher position of a front end of the first plate than that of a rear end of the first plate. The first plate is provided with an anti-slip portion. A shield piece adjacent to the first connecting portion is disposed on the first, second or third plate.

Preferably, a height of the front end of the second plate is greater than that of a rear end of the second plate, so that a top surface of the second plate is angled at 5-15 degrees to a bottom surface of the second plate.

Preferably, the hanging hole includes an upper beam portion with a first end far away from the opening and a second end close to the opening, the first end being connected to a front edge of the top portion of the frame, the second end being connected to a rear edge of the top portion of the frame, the front edge being in front of the rear edge in a thickness direction of the top portion of the frame, the upper beam portion extending parallel to a second vertical plane which is not parallel to the first vertical plane.

Preferably, the first connecting portion includes a first cavity and a first hook which extends toward an outside of the opening while the second connecting portion includes a second cavity and a second hook which extends toward an inside of the opening. The second hook is detachably fitted with the first cavity. The second cavity is detachably fitted with the first hook.

Furthermore, a notch is disposed on the first hook while a block is disposed on the second cavity. The block inserts into the notch when the first hook and the second cavity are fitted together.

Preferably, the anti-slip portion includes a plurality of first ribs disposed on a top surface of the first plate. The anti-slip portion further includes a plurality of spikes disposed on the first ribs.

Preferably, the shield piece is disposed on the second plate. The second plate is further provided with a supporting piece opposite to the shield piece. The supporting piece supports against the frame.

Preferably, a top surface of the second plate is surrounded by a wall with an inner flange portion disposed at a top end thereof. The first plate is disposed inside the wall. A recess portion complementary to the inner flange portion is provided on a top surface of the first plate.

Preferably, a bottom surface of the second plate is provided with a plurality of upper buffer spaces separated by a plurality of second ribs. The second ribs are symmetrically distributed on both sides of an imaginary midline defined on the bottom surface of the second plate.

Furthermore, a top surface of the third plate is provided with a plurality of lower buffer spaces separated by a plurality of third ribs which each engages with the second ribs. The lower buffer spaces are in communication with the upper buffer spaces respectively.

Preferably, the bottom portion of the frame includes a raised portion while the groove portion includes an inserted portion complementary to the raised portion.

DETAILED DESCRIPTION OF THE INVENTION

Figure 1:
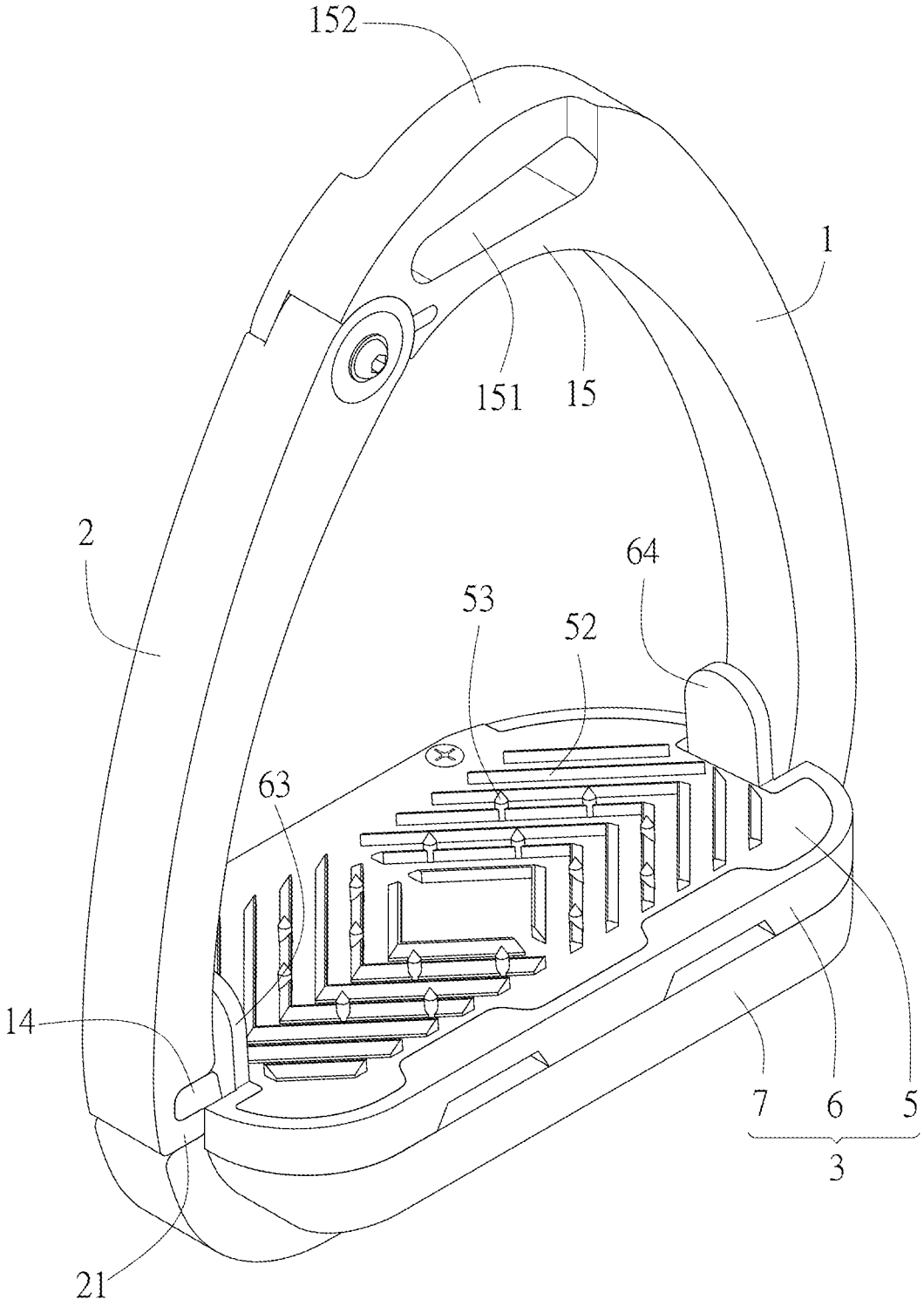
FIG. 1 is a perspective view of the present invention.
Figure 2:
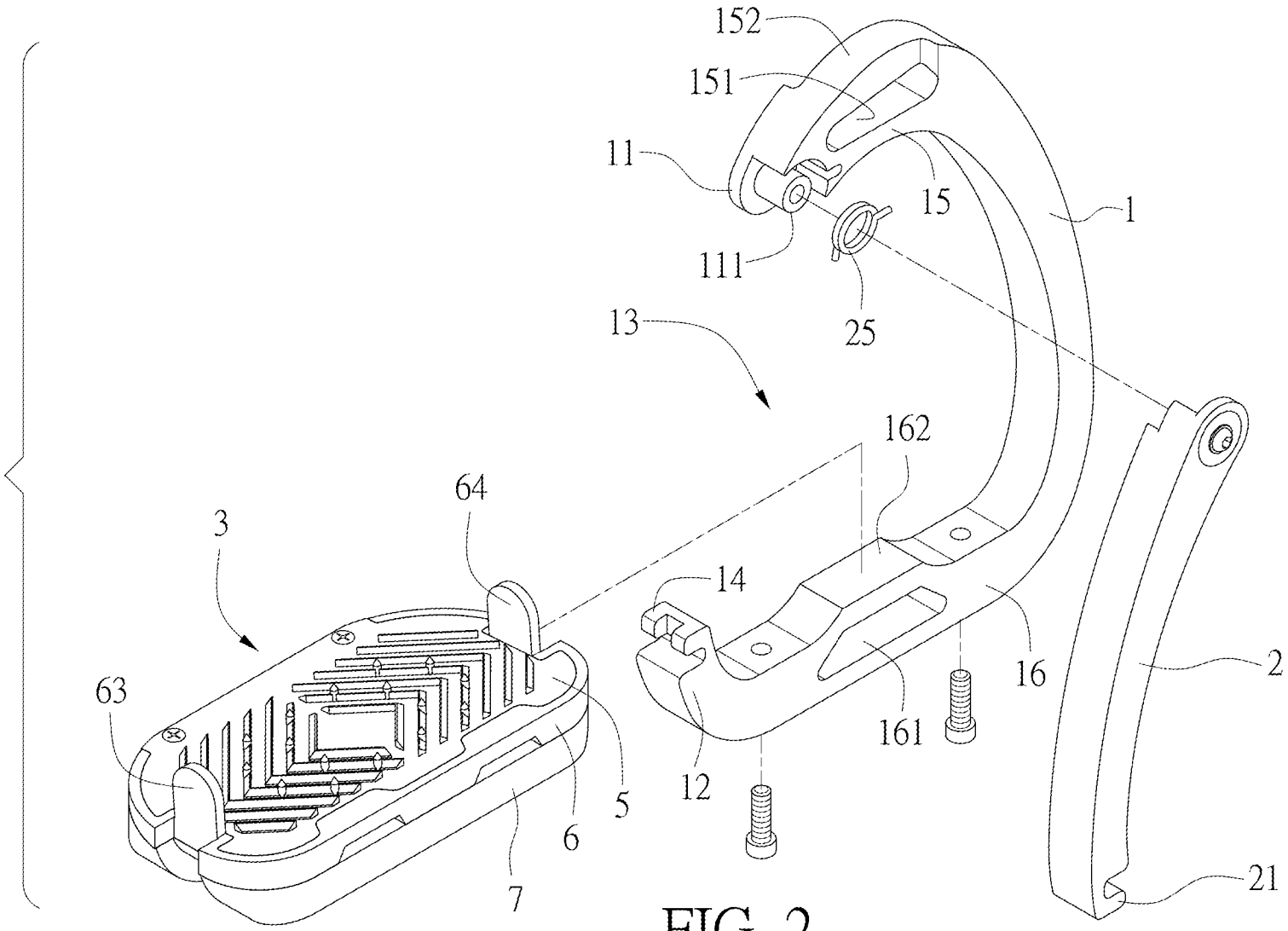
FIG. 2 is an exploded perspective view of the present invention.
Figure 5:
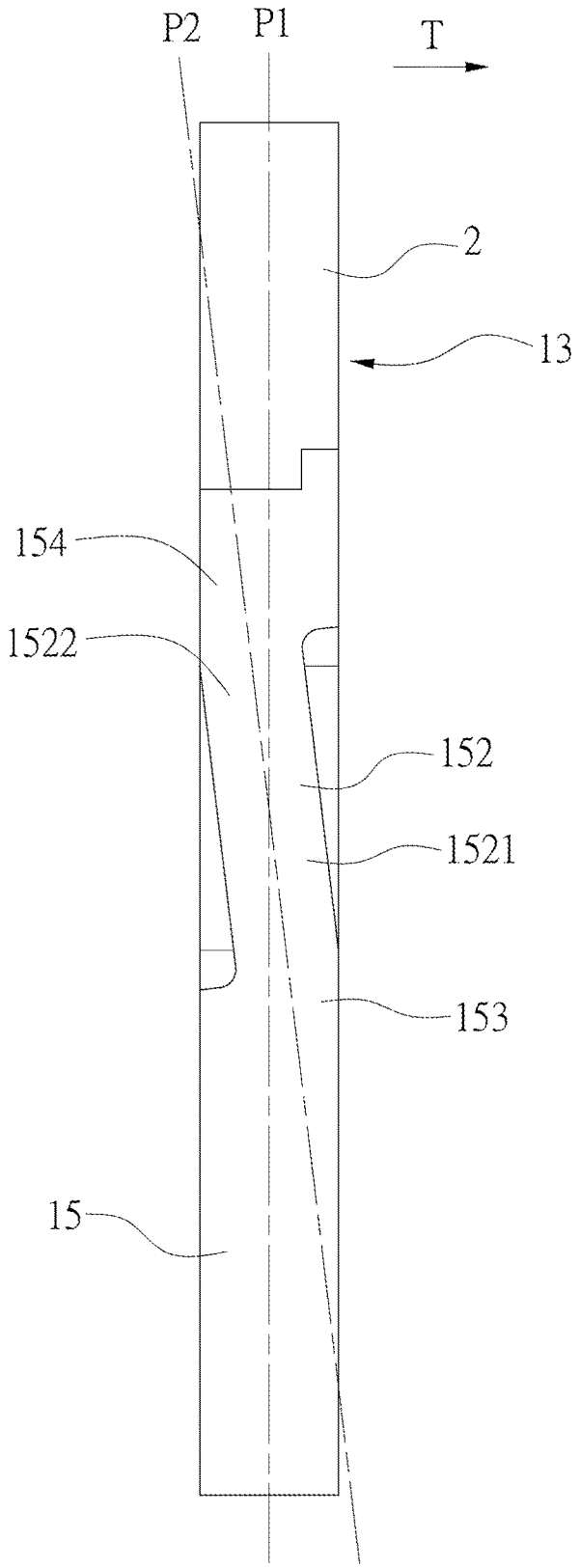
FIG. 5 is a top view of the frame of the present invention.

Referring to FIG. 1 and FIG. 2, the safety stirrup according to the present invention includes a frame 1, an arm 2 and a supporting assembly 3. The frame 1 extends parallel to a first vertical plane P1 (which is shown in FIG. 5) and forms a C shape. The frame has an upper end 11 and a lower end 12, and an opening 13 is defined between the upper end 11 and the lower end 12. A pivot portion 111 is disposed at the upper end 11 while a first connecting portion 14 is disposed at the lower end 12. A strap can tie with the frame 1 to hang the stirrup at a side of a horse via a hanging hole 151 disposed on a top portion 15 of the frame 1. A bottom portion 16 of the frame 1 includes a raised portion 162 with a lightening hole 161.

Figure 3:
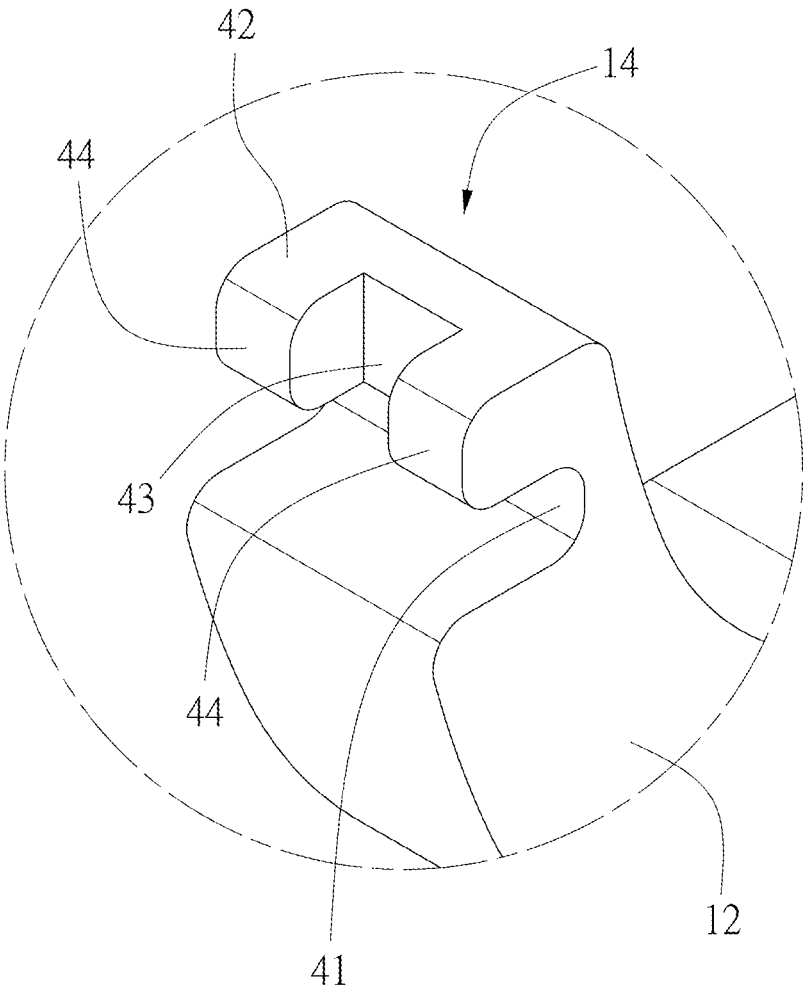
FIG. 3 is an enlarged perspective view of the first connecting portion of the present invention.

As shown in FIG. 3, the first connecting portion 14 forms a hook shape and includes a first cavity 41 and a first hook 42 which extends toward an outside of the opening. Furthermore, a notch 43 is disposed in the middle of the first hook 42, and thus there are two restricting portions 44 defined on both sides of the notch 43.

Figure 4:
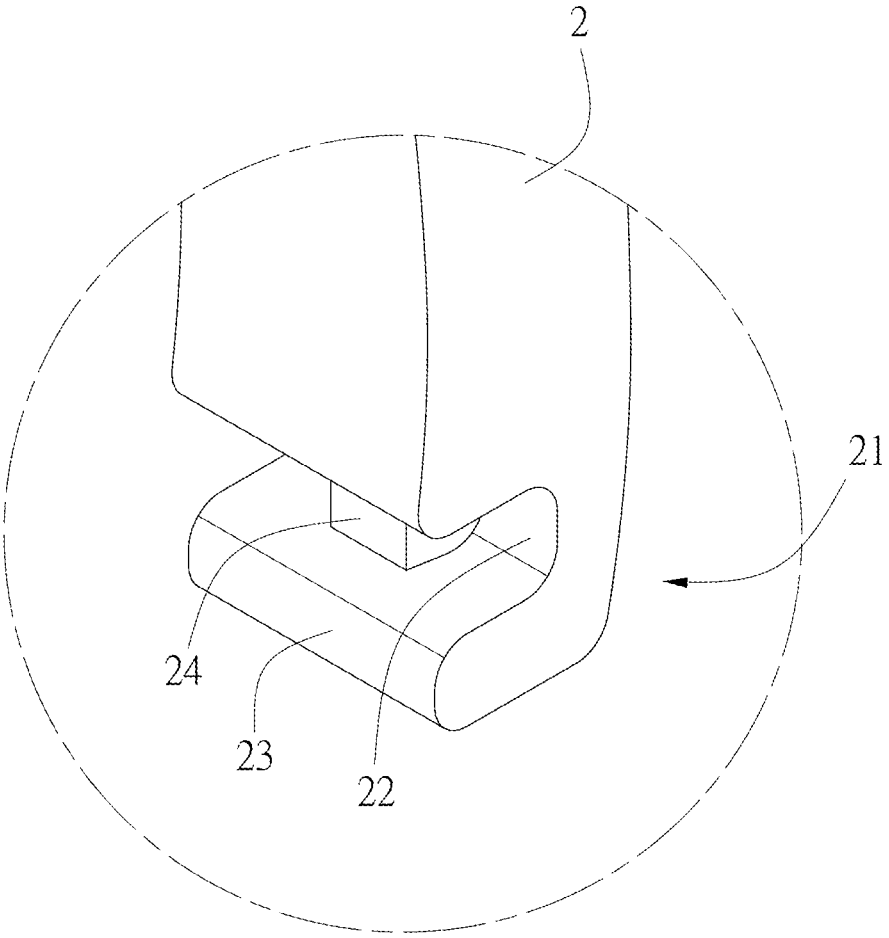
FIG. 4 is an enlarged perspective view of the second connecting portion of the present invention.

The arm 2 has a length equivalent to the opening 13. One end of the arm 2 is pivotally connected with the pivot portion 111 so as to swing on the first vertical plane. The other end of the arm 2 is provided with a second connecting portion 21. As shown in FIG. 4, the second connecting portion 21 forms a hook shape and includes a second cavity 22 and a second hook 23 which extends toward an inside of the opening. Furthermore, a block 24 is disposed in the middle of the second cavity 22. The arm 2 pivots on the pivot portion 111 so that the opening 13 is opened or closed. In this embodiment, a spring 25 is disposed between the pivot portion 111 and the arm 2 to make the arm 2 be normally kept in a position which closes the opening 13. The first connecting portion 14 and the second connecting portion 21 are fitted together when the opening 13 is closed by the arm 2. In detail, the first cavity 41 of the frame 1 is inserted by the second hook 23 of the arm 2, and the second cavity 22 of the arm 2 is inserted by the first hook 42 of the frame 1. In the meanwhile, the block 24 inserts into the notch 43 and is restricted by the restricting portions 44 from laterally moving, which ensures the arm 2 only moves on the first vertical plane.

Figure 6:
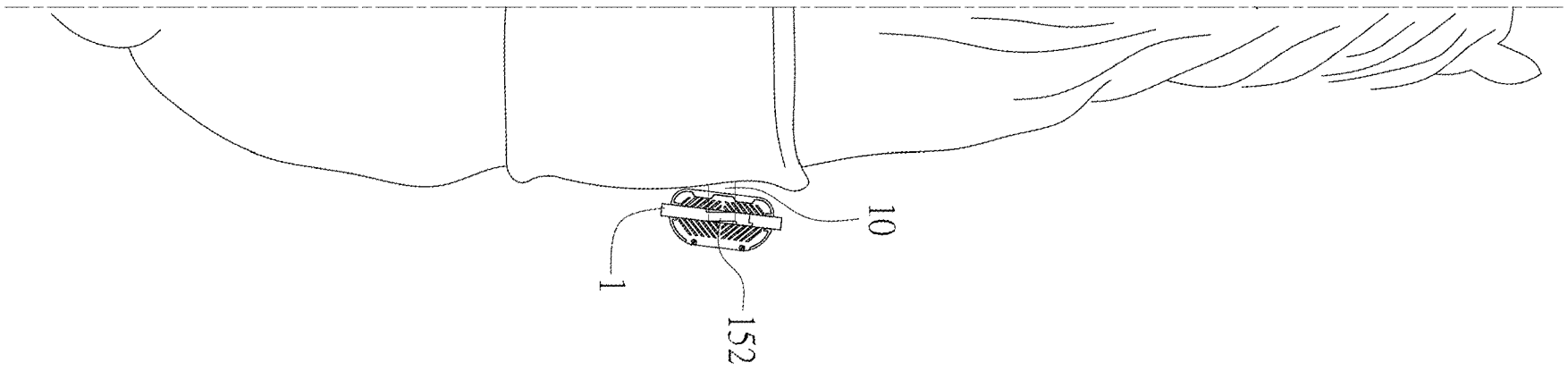
FIG. 6 is a top view showing that the present invention is hung at a side of a horse naturally.

The hanging hole 151 includes an upper beam portion 152 with a thickness less than that of the top portion 15 of the frame 1. A thickness direction T of the top portion 15 of the frame 1 is defined. The upper beam portion 152 has a first end 1521 far away from the opening 13 and a second end 1522 close to the opening 13. As shown in FIG. 5, the first end 1521 is connected to a front edge 153 of the top portion 15 of the frame 1 while the second end 1522 is connected to a rear edge 154 of the top portion 15 of the frame 1. The front edge 153 is in front of the rear edge 154 in the thickness direction T. Therefore, the upper beam portion 152 extends parallel to a second vertical plane P2 which is not parallel to the first vertical plane P1. In other word, the upper beam portion 152 is skewed with respect to the frame 1 so that the stirrup, referring to FIG. 6, will rotate slightly after hanging the stirrup by a strap 10 as a result of modification of the extension of the upper beam portion 152 to facilitate putting the foot into the stirrup.

Figure 7:
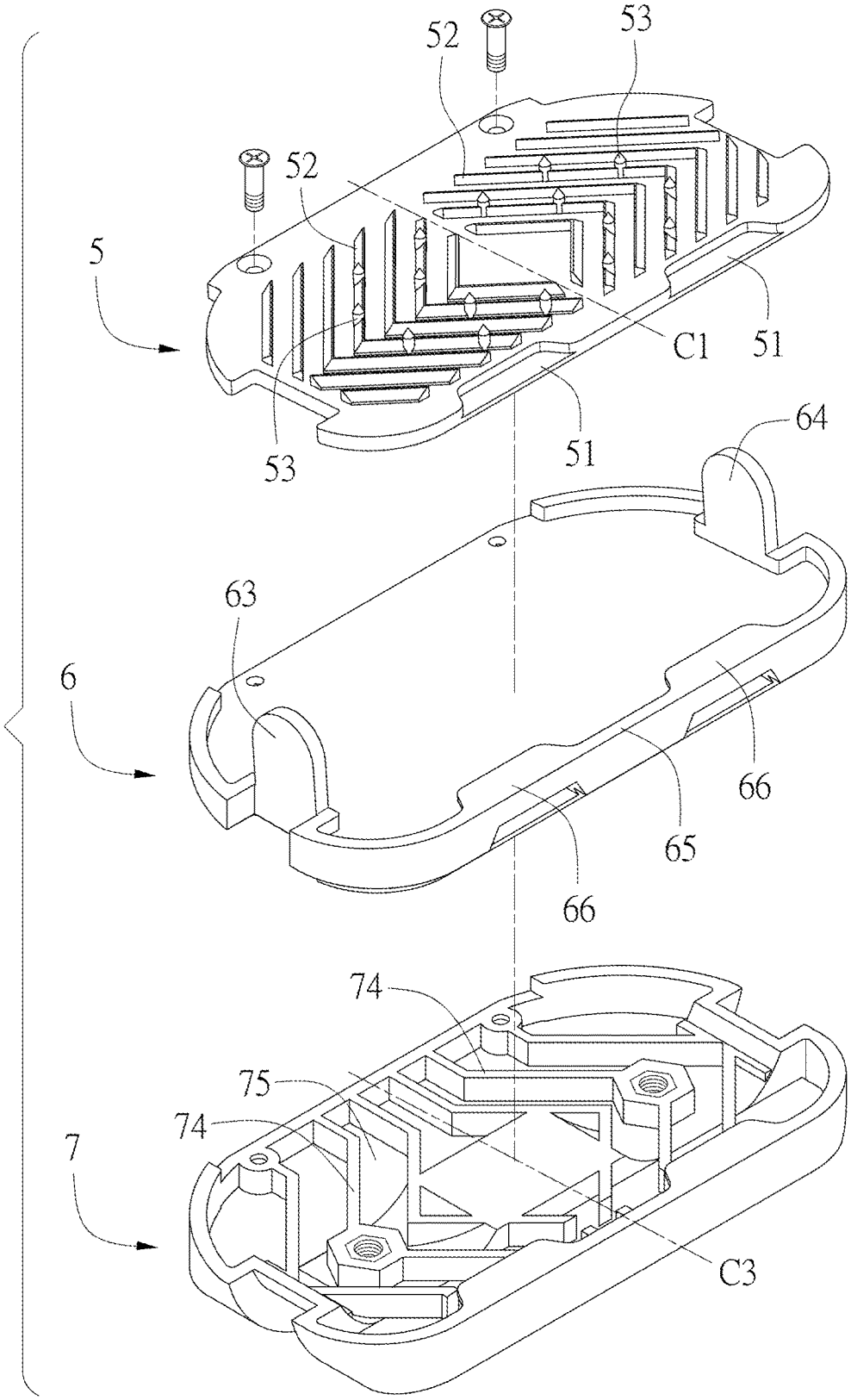
FIG. 7 and FIG. 8 are exploded perspective views of the supporting assembly of the present invention.
Figure 8:
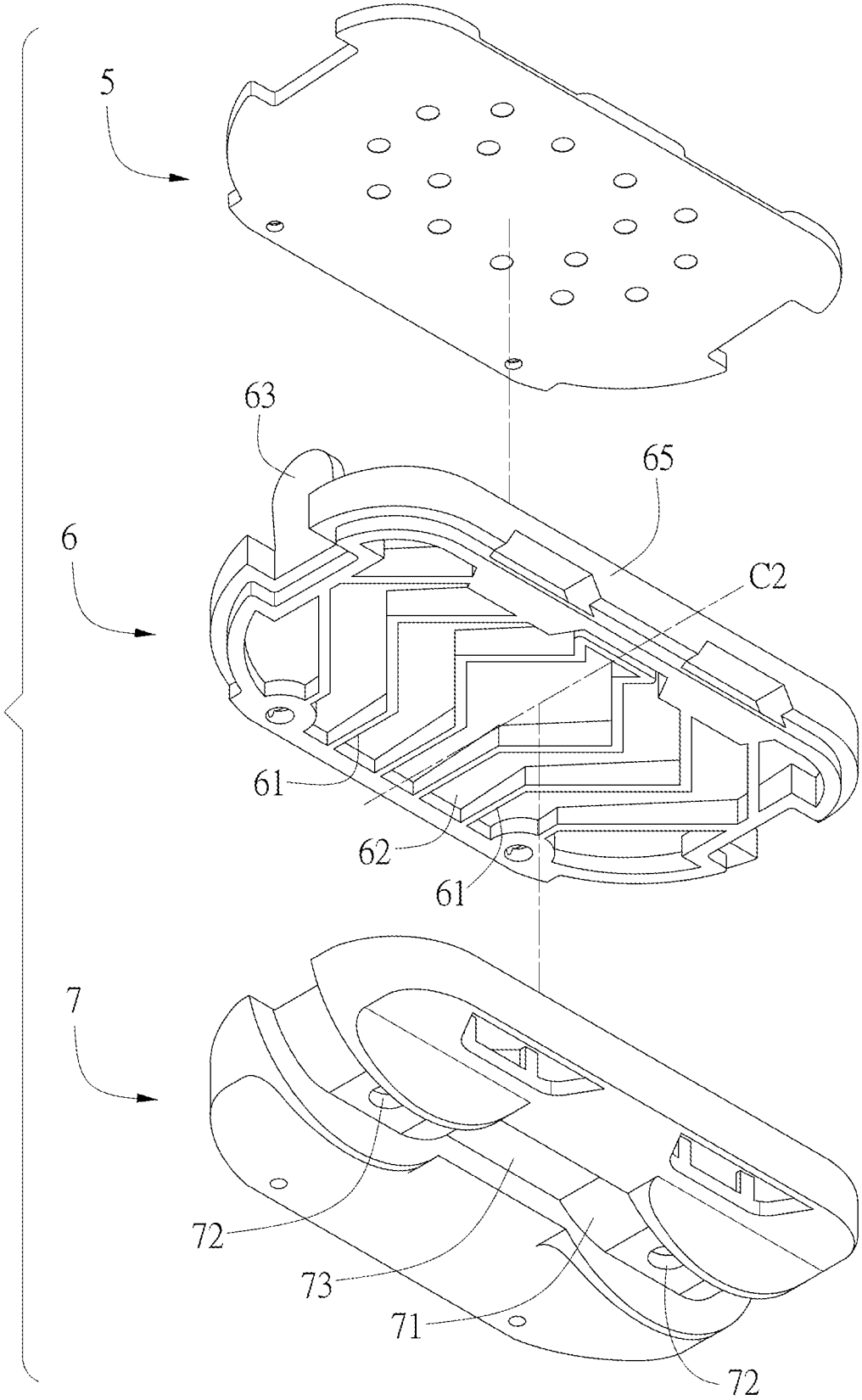
Figure 9:
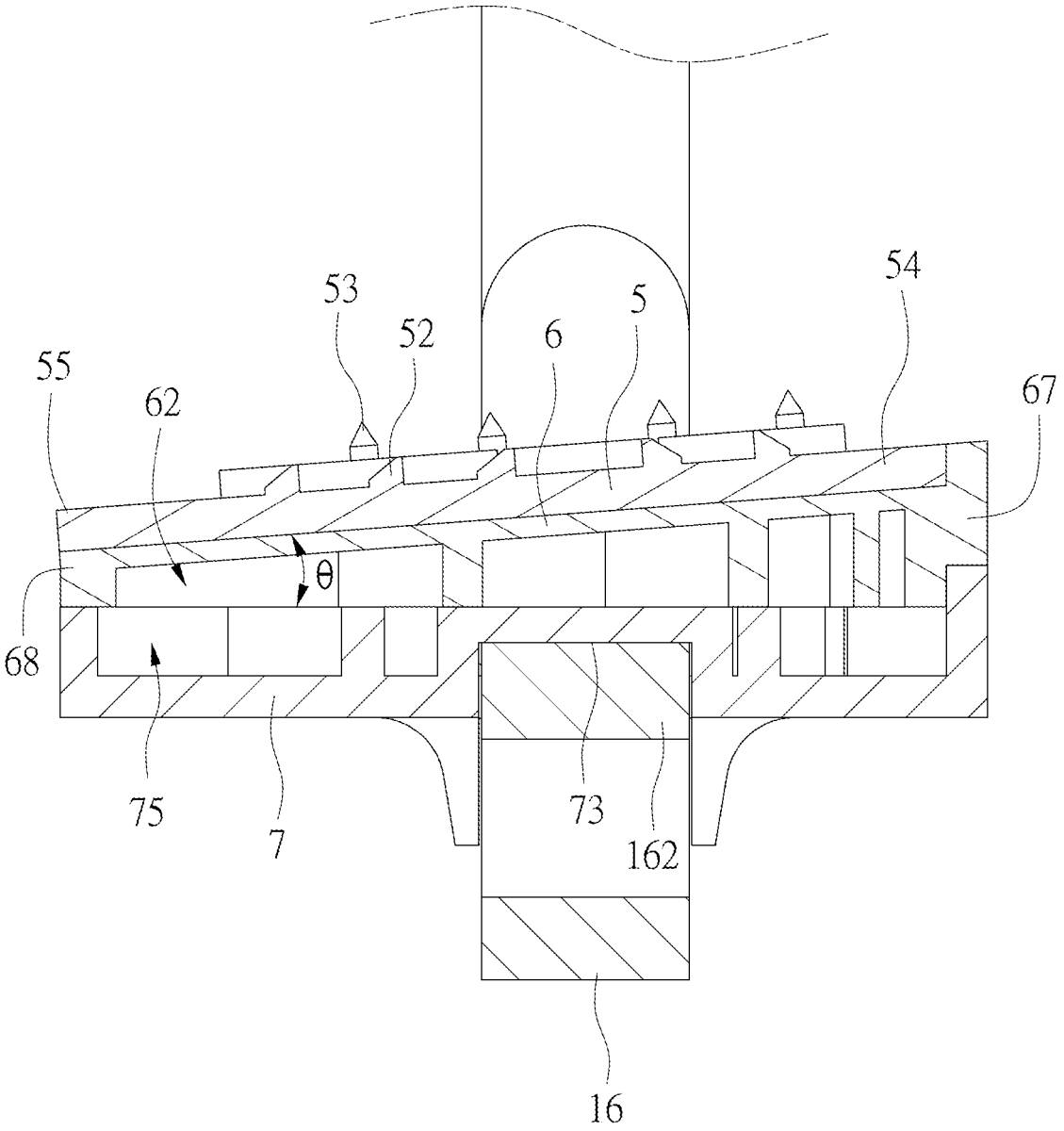
FIG. 9 is a sectional view of the supporting assembly of the present invention.

Referring to FIGS. 7, 8 and 9, the supporting assembly 3 consists of a first plate 5, a second plate 6 and a third plate 7. A groove portion 71 with an inserted portion 73 complementary to the raised portion 162 and two screw holes 72 provided on two sides of the inserted portion 73 is disposed on a bottom surface of the third plate 7. Accordingly, the groove portion 71 is fitted with the bottom portion 16 of the frame 1, and then the third plate 7 is fixed by screws which penetrate through the screw holes 72. The third plate 7 is positioned more firmly because the inserted portion 73 is inserted by the raised portion 162.

A top surface of the third plate 7 is provided with several third ribs 74. These third ribs 74 are symmetrically distributed on both sides of an imaginary midline C3 defined on the top surface of the third plate 7. There are several lower buffer spaces 75 formed between adjacent third ribs 74.

The second plate 6 is stacked on the third plate 7. The second plate 6 is soft and elastic. A bottom surface of the second plate 6 is provided with several second ribs 61. These second ribs 61 are symmetrically distributed on both sides of an imaginary midline C2 defined on the bottom surface of the second plate 6. There are several upper buffer spaces 62 formed between adjacent second ribs 61. Since shapes and positions of the second ribs 61 are corresponding to that of the third ribs 74, the second ribs 61 engage with the third ribs 74, and the upper buffer spaces 62 communicate with the lower buffer spaces 75. Air is accommodated in the upper buffer spaces 62 and the lower buffer spaces 75. The second plate 6 deforms when pressed, and the upper buffer spaces 62 deform as well, thereby cushioning the impact force.

A height of the front end 67 of the second plate 6 is greater than that of a rear end 68 of the second plate 6, so that a top surface of the second plate is angled at 5-15 degrees to a bottom surface of the second plate 6.

One side of the second plate 6 which is close to the opening 13 is provided with a shield piece 63. The shield piece 63 is adjacent to the first connecting portion 14 and is tall enough to laterally block the first connecting portion 14 and the second connecting portion 21 from being directly kicked by rider's foot, avoiding rider's foot from accidentally getting out of the stirrup. On the other hand, the second plate 6 is further provided with a supporting piece 64 opposite to the shield piece 63. The supporting piece 64 supports against the frame 1 to position the second plate 6.

A top surface of the second plate 6 is surrounded by a wall 65. The first plate 5 is stacked on the second plate 6 and abuts against the wall 65. Two inner flange portions 66 are disposed at a top end of the wall 65. Two recess portions 51 complementary to the inner flange portions 66 are provided on a top surface of the first plate 5 so that the first plate 5 is secured when the recess portions 51 and the inner flange portions 66 are fitted together.

Figure 10:
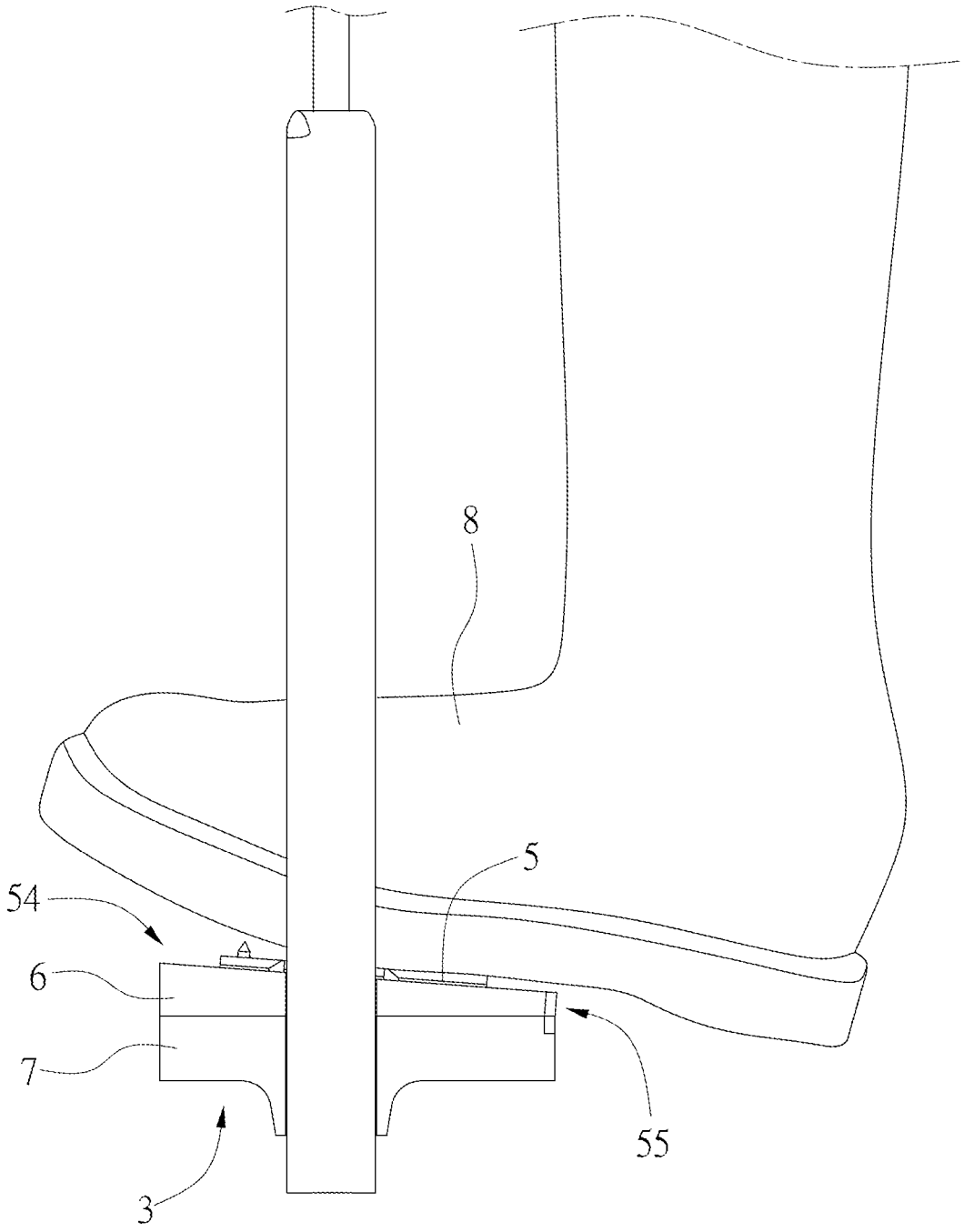
FIG. 10 is a plan view showing that a rider steps on the present invention.

The first plate 5 has an uniform height, but a front end 54 of the first plate 5 is higher than a rear end 55 of the first plate 5 due to the inclined top surface of the second plate 6. Referring to FIG. 10, based on a sole 8 of the rider tilting with a higher position of toes than that of a heel when tightening the muscle, the structure design of the first plate 5 in which the front end 54 is higher than the rear end 55 allows the sole 8 to be completely attached without affecting the posture.

The top surface of the first plate 5 is provided with an anti-slip portion which includes a plurality of first ribs 52. These first ribs 52 are symmetrically distributed on both sides of an imaginary midline C1 defined on the top surface of the first plate 5. Furthermore, several spikes 53 penetrate out of the first ribs 52 to facilitate slip-proofing.

One feature of this invention is that the upper beam portion 152 of the hanging hole 151 is skewed with respect to the frame 1 so that the stirrup will rotate slightly after hanging the stirrup by a strap 10 as a result of modification of the extension of the upper beam portion 152 to facilitate putting the foot into the stirrup.

Another one feature of this invention is that the supporting assembly 3 is composed of three plates and several deformable spaces so as to cushion the impact force by deformation of the second plate 6 and the upper buffer space 62 when a jumping horse lands.

Another one feature of this invention is that the supporting assembly 3 has an inclined top surface for a rider to put his foot and make the sole completely attach to the first plate 5.

What is claimed is:

1. A safety stirrup, comprising:

a C-shaped frame extending parallel to a first vertical plane, the frame having an upper end with a pivot portion, a lower end with a first connecting portion and an opening between the upper end and the lower end, a top portion of the frame being provided with a hanging hole for a strap to tie with;

an arm pivotally connected with the pivot portion to be swung parallel to the first vertical plane, the arm including a second connecting portion which is selectively secured to the first connecting portion to close the opening;

a supporting assembly comprising a first plate, a second plate with elasticity and a third plate, the third plate including a groove portion to be secured to a bottom portion of the frame, the second plate being stacked on the third plate with a higher position of a front end of the second plate than that of a rear end of the second plate, the first plate being stacked on the second plate with a higher position of a front end of the first plate than that of a rear end of the first plate, the first plate being provided with an anti-slip portion, a shield piece adjacent to the first connecting portion being disposed on the second plate;

wherein the first connecting portion includes a first cavity and a first hook which extends toward an outside of the opening while the second connecting portion includes a second cavity and a second hook which extends toward an inside of the opening, the second hook being detachably fitted with the first cavity, the second cavity being detachably fitted with the first hook;

wherein a notch is disposed on the first hook while a block is disposed on the second cavity, the block inserting into the notch when the first hook and the second cavity are fitted together;

wherein a top surface of the second plate is surrounded by a wall with an inner flange portion disposed at a top end thereof the first plate is disposed inside the wall, a recess portion complementary to the inner flange portion being provided on a top surface of the first plate;

wherein the bottom portion of the frame includes a raised portion while the groove portion includes an inserted portion complementary to the raised portion;

wherein a spring is disposed between the pivot portion and the arm to make the arm be normally kept in a position which closes the opening;

wherein the shield piece is tall enough to laterally block the first connecting portion and the second connecting portion.

2. The safety stirrup of claim 1, wherein a height of the front end of the second plate is greater than that of a rear end of the second plate, so that a top surface of the second plate is angled at 5-15 degrees to a bottom surface of the second plate.

3. The safety stirrup of claim 1, wherein the hanging hole includes an upper beam portion with a first end far away from the opening and a second end close to the opening, the first end being connected to a front edge of the top portion of the frame, the second end being connected to a rear edge of the top portion of the frame, the front edge being in front of the rear edge in a thickness direction of the top portion of the frame, the upper beam portion extending parallel to a second vertical plane which is not parallel to the first vertical plane.

4. The safety stirrup of claim 1, wherein the anti-slip portion includes a plurality of first ribs disposed on a top surface of the first plate.

5. The safety stirrup of claim 4, wherein the anti-slip portion further includes a plurality of spikes disposed on the first ribs.

6. The safety stirrup of claim 1, wherein the shield piece is disposed on the second plate, and the second plate is further provided with a supporting piece opposite to the shield piece, the supporting piece supporting against the frame.

7. The safety stirrup of claim 1, wherein a bottom surface of the second plate is provided with a plurality of upper buffer spaces separated by a plurality of second ribs.

8. The safety stirrup of claim 7, wherein the second ribs are symmetrically distributed on both sides of an imaginary midline defined on the bottom surface of the second plate.

9. The safety stirrup of claim 7, wherein a top surface of the third plate is provided with a plurality of lower buffer spaces separated by a plurality of third ribs which each engages with the second ribs, wherein the lower buffer spaces are in communication with the upper buffer spaces respectively.

* * * * *